US007572149B2

(12) United States Patent
Matsuura et al.

(10) Patent No.: US 7,572,149 B2
(45) Date of Patent: Aug. 11, 2009

(54) CONNECTOR

(75) Inventors: Ryuji Matsuura, Susono (JP); Teppei Doi, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 12/014,126

(22) Filed: Jan. 15, 2008

(65) Prior Publication Data

US 2008/0200048 A1 Aug. 21, 2008

(30) Foreign Application Priority Data

Feb. 16, 2007 (JP) ..... 2007-036390
Jun. 14, 2007 (JP) ..... 2007-157026

(51) Int. Cl.
*H01R 13/66* (2006.01)

(52) U.S. Cl. ..... 439/620.21

(58) Field of Classification Search ..... 439/620.01, 439/620.21, 620.22, 620.23
See application file for complete search history.

(56) References Cited

U.S. PATENT DOCUMENTS 7,114,985 B2 * 10/2006 Doorhy et al. ..... 439/404

FOREIGN PATENT DOCUMENTS

JP 2003-134720 A 5/2003

* cited by examiner

*Primary Examiner*—Ross N Gushi
(74) *Attorney, Agent, or Firm*—Sughrue Mion, PLLC

(57) ABSTRACT

A connector includes a control circuit portion having a circuit element, and a housing which has a fitting portion which fits to a mating connector, a receiving chamber which receives the control circuit portion, and a wire holding portion which holds wires connected to the control circuit portion. The wire holding portion is provided on the opposite side of the fitting portion. The wire holding portion holds the wires so that the wires extend in a fitting direction in which the housing fits to the mating connector.

14 Claims, 17 Drawing Sheets

CONNECTOR

BACKGROUND

This invention relates to a connector which contains various circuit elements and is used for the connection of wires or for other purposes.

Various electric equipments such as motors for an air-conditioner, wipers, power windows, etc., are mounted on an automobile serving as a mobile body. A wire harness is installed on the automobile so as to supply electric power and control signals to the electric equipments. The wire harness includes a plurality of wires, and connectors each receiving metal terminals connected to end portions of the wires. The wire is a so-called sheathed wire including an electrically-conductive core wire (conductor) and an insulative sheath covering the core wire.

As a connector of the above-mentioned wire harness, an electronic part-containing connector (see, for example, Patent Literature 1) containing a circuit element, etc., has been used for connecting an electronic equipment (such as an actuator) to a control unit (such as a computer) by a data communication network. The electronic part-containing connector of this kind has a lead frame (having the circuit element, etc., mounted thereon) contained in its housing.

Electric power for driving its circuit element is supplied to the electronic part-containing connector disclosed in the above Patent Literature 1. Therefore, in order that electric power can be positively supplied to the electronic part-containing connector of the above Patent Literature 1 with a simple construction, this connector is mounted on longitudinally-central portions of wires, and are connected to the wires in such a manner that the wires are led out from widthwise-opposite ends of the connector. A plurality of such electronic part-containing connectors are mounted on the wires, and are spaced from one each other in the longitudinal direction of the wires. These connectors are fitted respectively to various electronic equipments, and connect these electronic equipments to the network.

[Patent Literature 1] JP-A-2003-134720

The electronic part-containing connectors shown in the above Patent Literature 1 are mounted on the central portions of the wires in spaced relation to each other, and therefore when the connectors are assembled into a wire harness, these connectors appear as if they were mounted on a main wire portion of the wire harness.

On the other hand, an ordinary connector not provided with the above circuit element is mounted on end portions of the wires since it does not need to be supplied with electric power. Therefore, an ordinary wire harness formed by such connectors not provided with any circuit element appears as if the connectors were mounted on end portions of branch wires of the wire harness.

Therefore, it is difficult to combine the wire harness including the electronic part-containing connectors (shown in the above Patent Literature 1) with the wire harness including the ordinary connectors not containing any circuit element and to handle these combined wire harnesses as one wire harness when mounting these combined wire harnesses on an automobile or the like. Therefore, it is desired that the wire harness including the electronic part-containing connectors (shown in the above Patent Literature 1) can also be handled in a similar manner to the wire harness including the above ordinary connectors.

SUMMARY

It is therefore an object of this invention to provide a connector which can be handled in a similar manner to the conventional connector when it is assembled into a wire harness.

The above object has been achieved by a connector of the invention including:

a control circuit portion having a circuit element; and a housing including:

a fitting portion which fits to a mating connector;

a receiving chamber which receives the control circuit portion; and a wire holding portion which holds wires connected to the control circuit portion, wherein the wire holding portion is provided on the opposite side of the fitting portion; and wherein the wire holding portion holds the wires so that the wires extend in a fitting direction in which the housing fits to the mating connector.

Preferably, the housing includes a housing body having an opening through which the control circuit portion is received in the receiving chamber and a cover portion attached to the housing body to close the opening, and the wire holding portion is provided on the cover portion.

Preferably, the control circuit portion includes press-contacting blades which are connected in a press-contacting manner respectively to the wires.

Preferably, the wires include a power wire for supplying electric power to the circuit element and a grounding wire connected to the ground, and the wire holding portion holds the power wire and the grounding wire so that the power wire and the grounding wire are bent into a generally U-shape within the housing.

Here, it is preferable that the wires include a control wire for controlling an electronic device, and the connector further includes a cutting portion which cuts a bent portion of the control wire bent into a generally U-shape within the housing.

Here, it is preferable that a central portion of the wire holding portion in a direction perpendicular to the fitting direction is closer to the control wire than the power wire and the grounding wire.

Here, it is preferable that the cutting portion is provided on the control circuit portion.

Here, it is preferable that the cover portion includes: a body portion; and an upstanding wall extending perpendicularly from the body portion toward an inner surface of the housing body, the wire holding portion includes: parallel portions which hold the wires in parallel contiguous relation to the body portion; and intersecting portions which hold the wires so that the wires extend perpendicularly from the parallel portions in intersecting relation thereto, and are disposed in contiguous relation to the upstanding wall, and the holding portion holds the wires to install the wires on an inner surface of the cover portion so that the wires are bent into a generally L-shape.

Here, it is preferable that the parallel portions and the intersecting portions are generally in the form of groove concaves on the inner surface of the cover portion.

In the connector of the invention, the wire holding portion is provided on the opposite side of the fitting portion, and the wire holding portion holds the wires in such a manner that the wires extend in the direction of fitting of the mating connector. Therefore, this connector can be handled in a similar manner to an ordinary connector not containing a circuit element.

In the connector of the invention, the wire holding portion is provided on the cover portion, and therefore the wires are held by the wire holding portion, and then the cover portion is attached to the housing body, and merely by doing so, this connector can be assembled. Also, by separating the wires from the housing body, the cover portion can be removed from the housing body.

In the connector of the invention, the control circuit portion includes the press-contacting blades, and therefore the control circuit portion can be easily connected to the wires. Also, the connection between the control circuit portion and the wires can be easily canceled.

In the connector of the invention, the power wire and the grounding wire are installed in such a manner that each of the power wire and the grounding wire is bent into a generally U-shape within the housing, and therefore the power wire and the grounding wire can be used in common between a plurality of connectors.

In the connector of the invention, there is provided the cutting portion for cutting the bent portion of the control wire, and therefore in the assembled condition, the control wires are electrically insulated from each other between the plurality of connectors.

In the connector of the invention, a central portion of the wire holding portion in a direction perpendicular to the fitting direction is closer to the control wire than the power wire and the grounding wire, and therefore the radius of curvature of each of the power wire and the grounding wire can be made large, and besides the control wires separated from each other by cutting the bent portion can be disposed close to each other.

In the connector of the invention, the cutting portion is provided on the control circuit portion, and therefore when attaching the cover portion to the housing body, the cutting portion cuts the bent portion of the control wire. Therefore, merely by attaching the cover portion to the housing body, the bent portion of the control wire can be cut.

In the connector of the invention, the wire holding portion includes the parallel portions for holding the wires in parallel contiguous relation to the body portion, and the intersecting portions for holding the wires in such a manner that the wires extend perpendicularly from the parallel portions in intersecting relation thereto, and are disposed in contiguous relation to the upstanding wall, and the wires are installed on the inner surface of the cover portion in such a manner that each of the wires is bent into a generally L-shape. Therefore, when a load acts on the wires, this load can be received by the upstanding wall, and a load acting on the contact portions between the control circuit portion and the wires can be reduced.

In the connector of the invention, each of the parallel portions as well as each of the intersecting portions is generally in the form of a groove of a channel-shaped cross-section recessed from the inner surface of the cover portion, and therefore the wires are less liable to be disengaged from the cover portion.

As described above, the connector of the invention can be handled in a similar manner to an ordinary connector not provided with a circuit element, and therefore the electronic part-containing connector can be disposed at ends of the wires, that is, at ends of branch wires of a wire harness. Therefore, even when the wire harness provided with the electronic part-containing connectors is combined with a wire harness provided with ordinary connectors, such combined wire harnesses can be installed on an automobile or the like in a similar manner to a wire harness provided with the ordinary connectors. Therefore, the connectors of the invention, when assembled into the wire harness, can be handled in a similar manner to the conventional ordinary connector.

In the invention, the wires are held by the wire holding portion, and then the cover portion is attached to the housing body, and merely by doing so, the connector of the invention can be assembled, and therefore the assembling operation can be easily effected. Also, by separating the wires from the housing body, the cover portion can be removed from the housing body, and therefore the connector can be easily disassembled.

In the invention, the control circuit portion can be easily connected to the wires, and therefore the connector can be more easily assembled. Also, the connection between the control circuit portion and the wires can be easily canceled, and therefore the disassembling operation can be more easily effected.

In the invention, the power wire and the grounding wire can be used in common between the plurality of connectors, and therefore the increase of the number of the wires forming the wire harness can be reduced.

In the invention, in the assembled condition, the control wires are electrically insulated from each other between the plurality of connectors, and therefore even with the use of a simple communication system, the wire harness can transmit desired control information without inviting a crossed line.

In the invention, the radius of curvature of each of the power wire and the grounding wire can be made large, and therefore the power wire and the grounding wire can be prevented from being accidentally cut. And besides, the control wires separated from each other by cutting the bent portion can be disposed close to each other, and therefore the housing and hence the connector itself can be formed into a compact design.

In the invention, merely by attaching the cover portion to the housing body, the bent portion of the control wire can be cut, and therefore the connector of the invention can be more easily assembled.

In the invention, when a load acts on the wires, this load can be received by the upstanding wall, and a load acting on the contact portions between the control circuit portion and the wires can be reduced, and therefore incomplete connection between the control circuit portion and the wires can be suppressed.

In the invention, the wires are less liable to be disengaged from the cover portion, and therefore the cover portion can be positively removed from the housing body by separating the wires from the housing body.

BRIEF DESCRIPTION OF THE DRAWINGS

The above objects and advantages of the present invention will become more apparent by describing in detail preferred exemplary embodiments thereof with reference to the accompanying drawings, wherein like reference numerals designate like or corresponding parts throughout the several views, and wherein.

DETAILED DESCRIPTION OF PREFERRED EMBODIMENTS

One preferred embodiment of an electronic part-containing connector (hereinafter referred to merely as "connector") of the present invention will now be described with reference to FIGS. 1 to 9.

Figure 1:
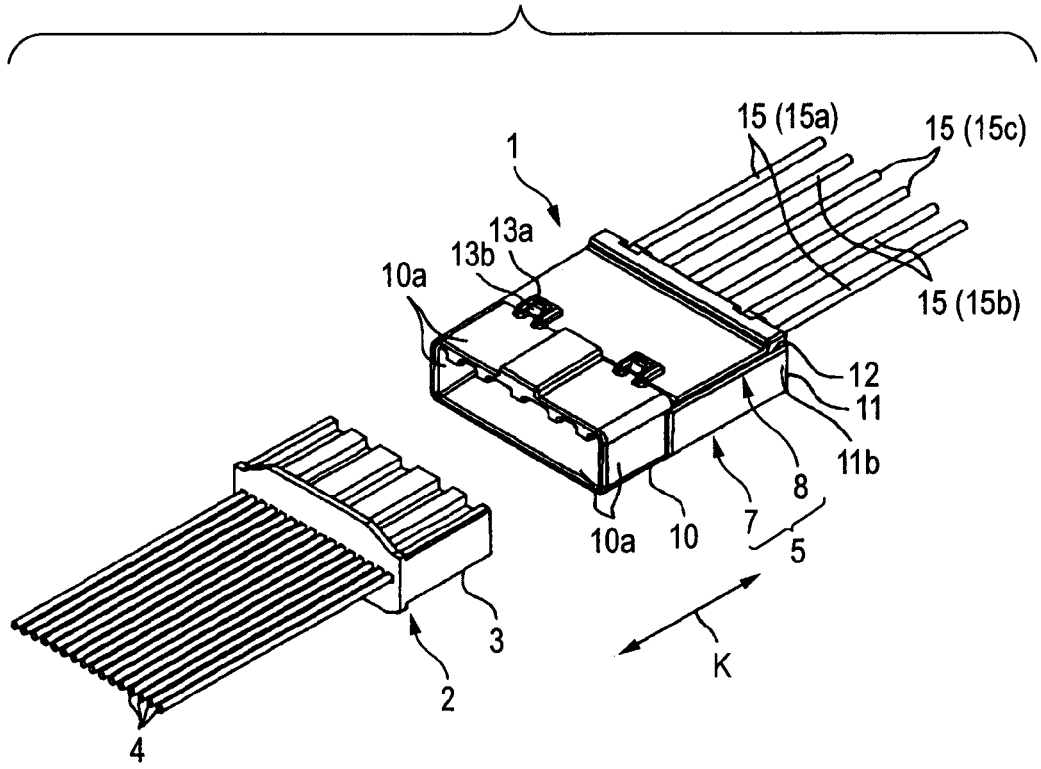
FIG. 1 is a perspective view showing one preferred embodiment of an electronic part-containing connector of the present invention and a mating connector.
Figure 2:
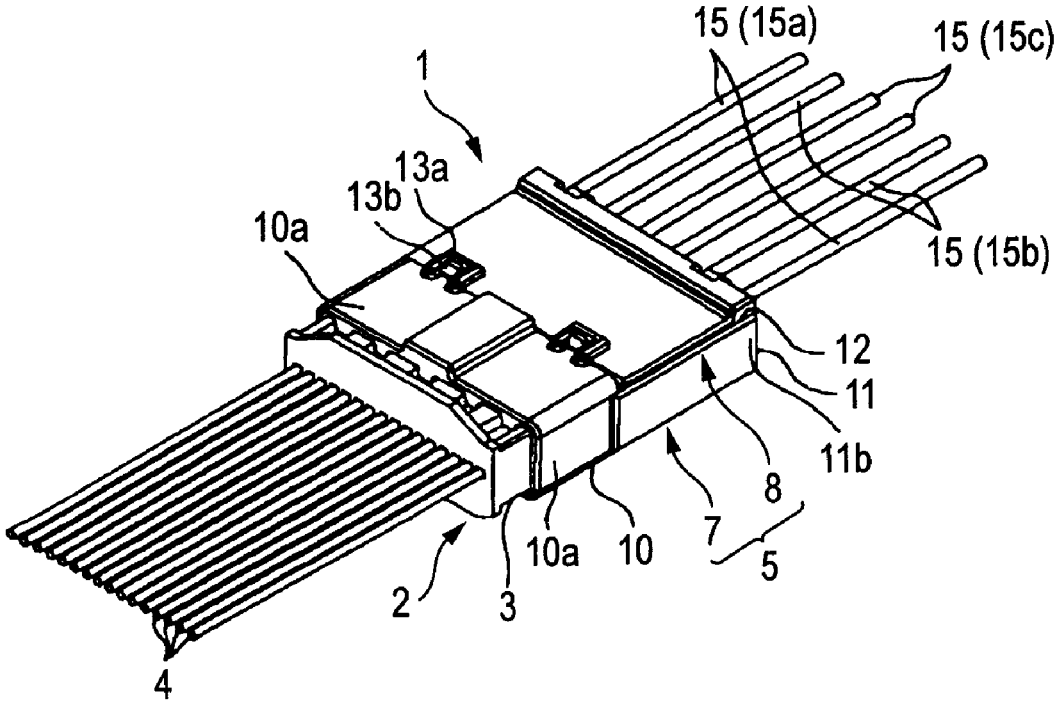
FIG. 2 is a perspective view showing a condition in which the two connectors of FIG. 1 are fitted to each other.

As shown in FIGS. 1 and 2, the connector 1 fits to a mating connector 2. The mating connector 2 includes a connector housing 3, and metal terminals (not shown) serving as external terminals. The connector housing 3 is made of an insulative synthetic resin, and is formed into a flattened box-like shape. The connector housing 3 receives the metal terminals therein.

There are provided the plurality of metal terminals, and wires 4, each including a core wire (conductor) and a sheath covering the core wire, are connected respectively to these metal terminals. The metal terminals are electrically connected respectively to the core wires of these wires 4. The wires 4, as described later, connected to the respective metal terminals of the mating connector 2 are connected to various switches 30 (shown in FIGS. 8 and 9) mounted on an automobile or the like. The switches 30 serves as an electronic device.

Figure 3:
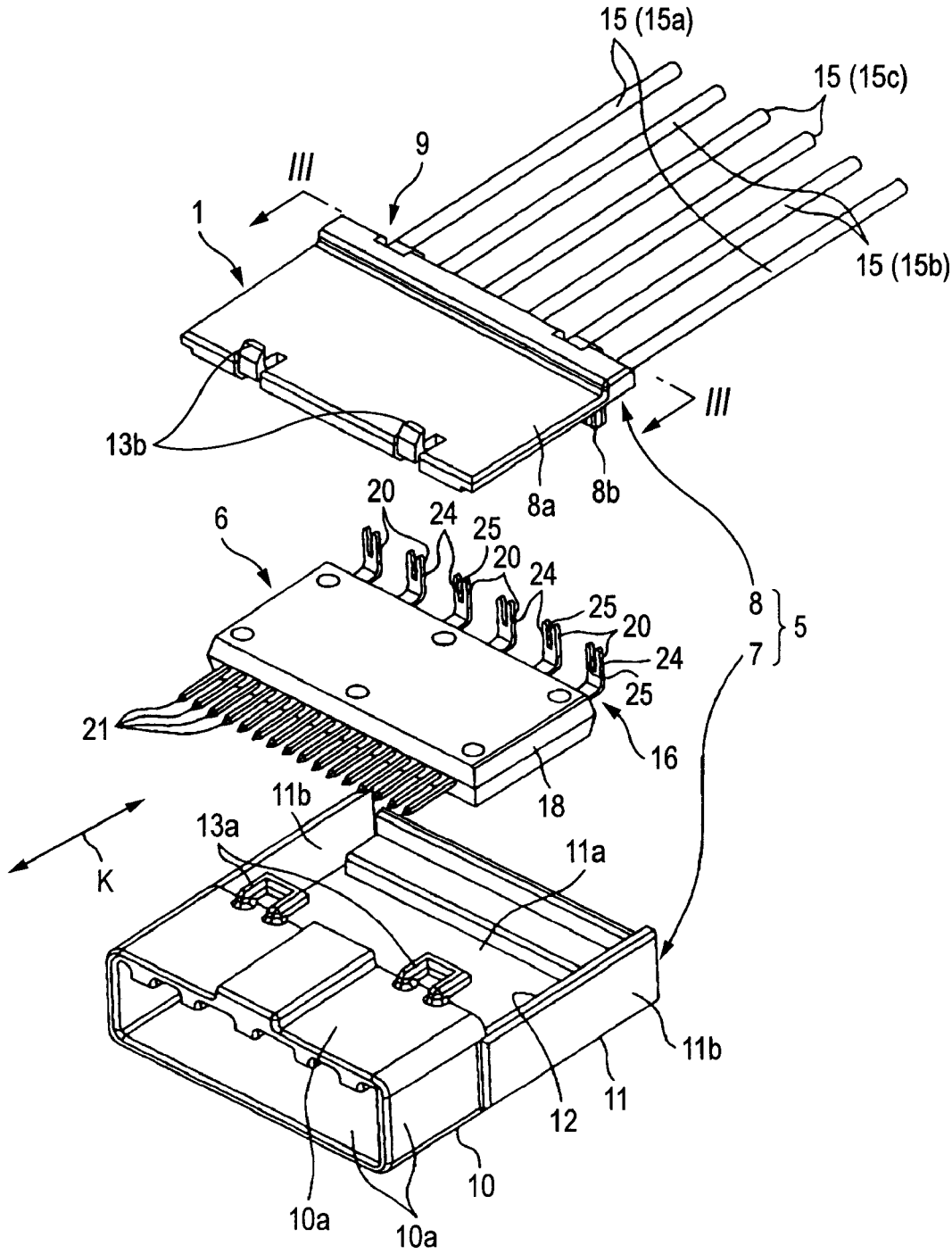
FIG. 3 is an exploded perspective view of the electronic part-containing connector of FIG. 1.
Figure 4:
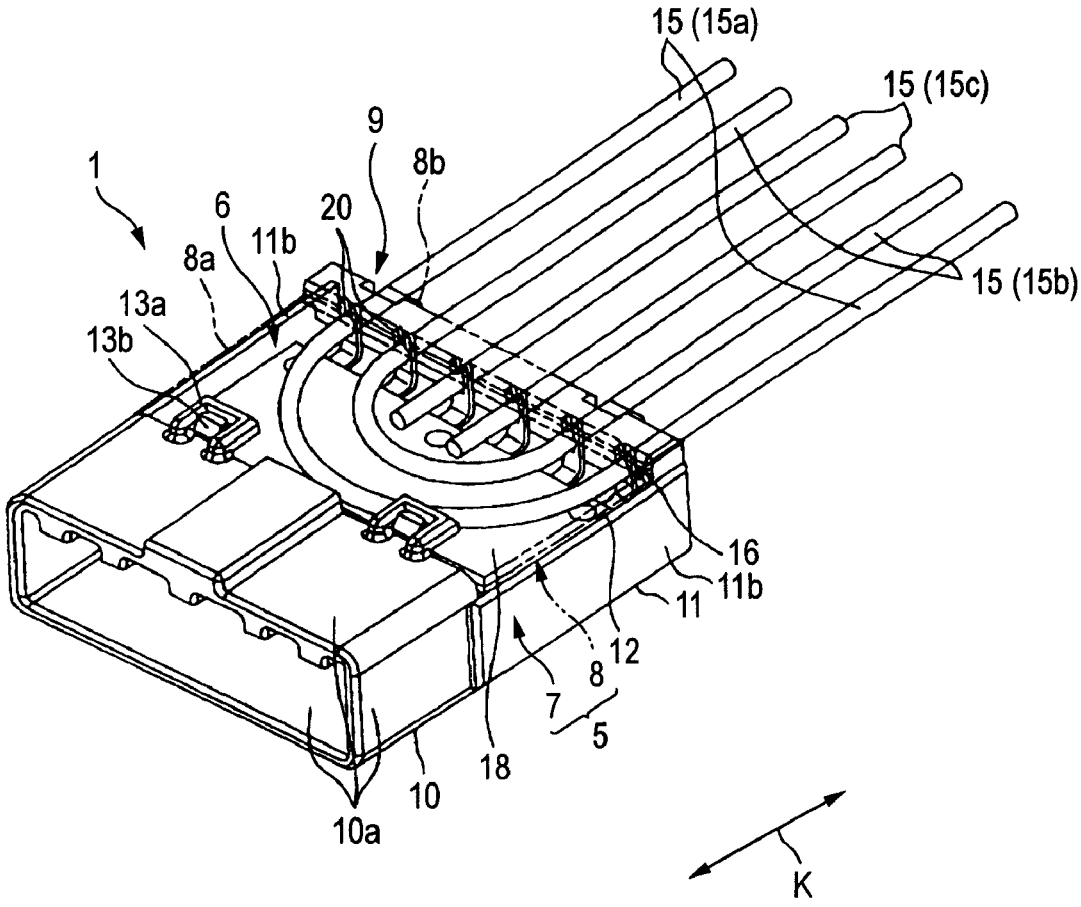
FIG. 4 is a perspective view of the electronic part-containing connector of FIG. 3.

As shown in FIGS. 3 and 4, the connector 1 includes an outer housing 5 (serving as a housing), and a control circuit package 6 serving as a control circuit portion. The outer housing 5 is formed into a flattened box-like shape, and includes a housing body 7, a cover portion 8, and a wire holding portion 9 (shown in FIG. 6).

The housing body 7 is made of an insulative synthetic resin, and includes a tubular hood portion 10 (serving as a fitting portion), and a control circuit package-receiving chamber 11 (serving as a receiving chamber) formed integrally with the hood portion 10 in continuous relation thereto. The connector housing 3 of the mating connector 2 is inserted into the hood portion 10, so that the hood portion 10 is fitted on the mating connector 2. When the mating connector 2 is to be fitted into the hood portion 10, the mating connector 2 is moved toward the hood portion 10 in a direction of arrow K which is parallel to all of wall surfaces 10*a* forming the hood portion 10. The direction of arrow K is a fitting direction of fitting of the outer housing to the mating connector 2.

The control circuit package-receiving chamber 11 includes a bottom wall 11*a* continuous with one wall surface 10*a* of the hood portion 10, and a pair of opposed side walls 11*b* formed on and extending upwardly respectively from opposite side edges of the bottom wall 11*a* in spaced relation to each other, this chamber 11 having a generally U-shaped cross-section. The pair of side walls 11*b* are continuous also with other side surfaces 10*a* of the hood portion 10. The control circuit package-receiving chamber 11 is open at its upper side (FIG. 3), and therefore has an opening 12. Naturally, the interior and exterior of the control circuit package-receiving chamber 11 communicate with each other through this opening 12.

Figure 5:
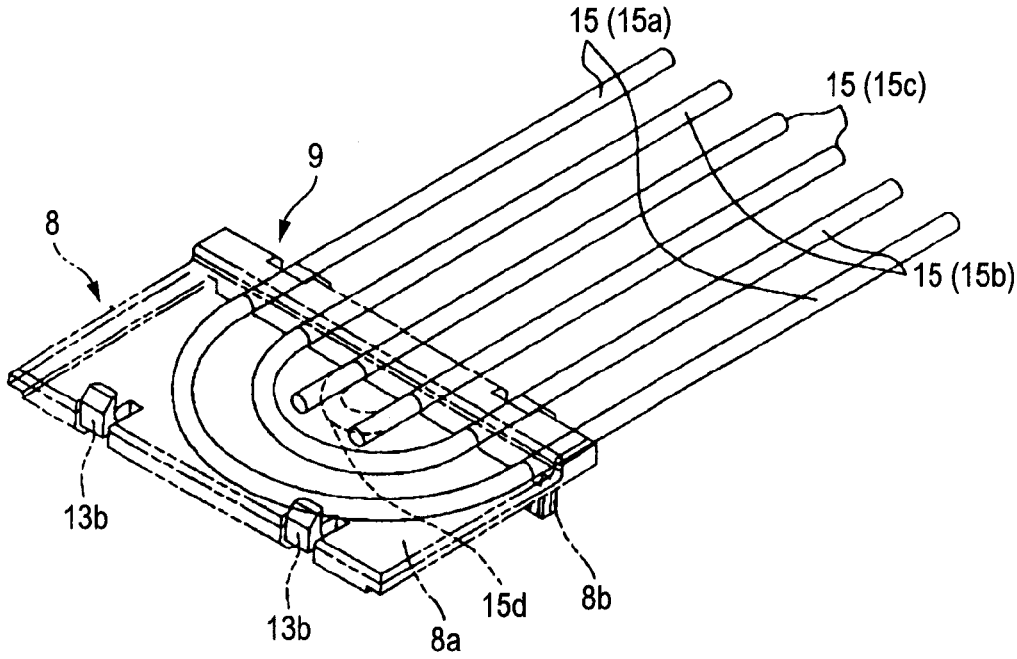
FIG. 5 is a perspective view of a cover portion of the electronic part-containing connector of FIG. 3.

The cover portion 8 is made of an insulative synthetic resin, and includes a top wall 8*a* serving as a flat plate-like body portion, and a rear wall 8*b* (serving as an upstanding wall) formed integrally with and extending perpendicularly from an outer edge (rear edge) of the top wall 8*a* toward the inner surface of the housing body 7 as shown in FIG. 5. The cover portion 8 is attached to the housing body 7. When the cover portion 8 is attached to the housing body 7, this cover portion 8 closes the opening 12. When the cover portion 8 is thus attached to the housing body 7, the top wall 8*a* is opposed to the bottom wall 11*a* in spaced relation thereto, and also the rear wall 8*b* is disposed at a rear side of the housing body 7 when the connector 1 is viewed from the front side of the hood portion 10.

The housing body 7 and the cover portion 8 have engagement portions 13*a* and engagement portions 13*b* which engages with each other. The engagement portions 13*a* are provided at the housing body 7, and are formed on that portion of the upper wall surface 10*a* (FIG. 3) forming an edge portion of the opening 12, and extend toward the opening 12. Each engagement portion 13*a* has a through hole formed therethrough such that it has a generally U-shaped cross-section. The pair of engagement portions 13*a* are formed on that portion of the upper wall surface 10*a* forming the edge portion of the opening 12, and are spaced from each other in a direction perpendicular to the fitting direction K.

The engagement portions 13*b* are provided at the cover portion 8. Each engagement portion 13*b* is formed by a portion of the top wall 8*a* lying between slits formed in this top wall 8*a*, and a distal end portion of the portion surrounded by the slits projects outwardly from the top wall 8*a* to assume a hook-shaped cross-section. The pair of engagement portions 13*b* are formed at that end of the top wall 8*a* remote from the rear wall 8*b*, and are spaced from each other in a direction perpendicular to the fitting direction K. When the cover portion 8 is attached to the housing body 7, the hook-shaped distal end portion of each engagement portion 13*b* fits into the through hole of the corresponding engagement portion 13*a*, so that the two engagement portions 13*a* and 13*b* are engaged with each other.

Figure 6:
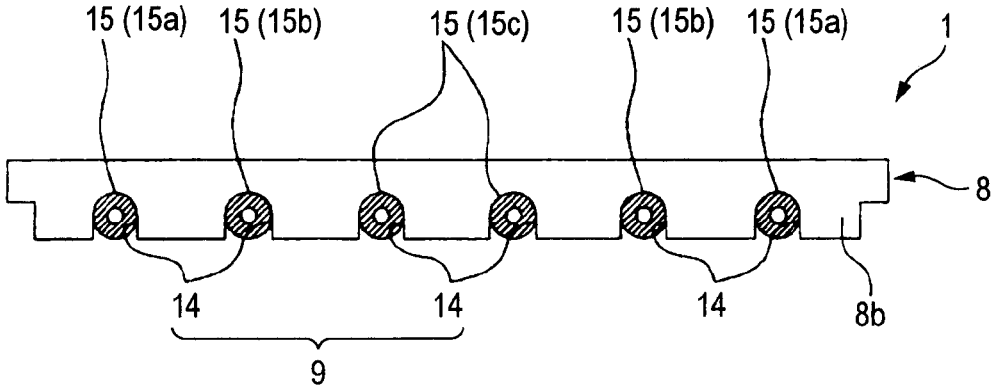
FIG. 6 is a cross-sectional view taken along the line III-III of FIG. 3.

As shown in FIGS. 5 and 6, the wire holding portion 9 has a plurality of wire receiving grooves 14 formed in the rear wall 8*b* of the cover portion 8. Therefore, the wire holding portion 9 is provided at the rear side of the cover portion 8 (that is, at the rear side of the outer housing 5) when viewed from the front side of the hood portion 10. The wire receiving grooves 14 are defined respectively by notches each formed in a lower edge of the rear wall 8*b* remote from the top wall 8*a* and extending toward the top wall 8*a*. The plurality of wire receiving grooves 14 are arranged at predetermined intervals. Each wire receiving groove 14 holds the wire 15 passed therethrough.

The wire receiving grooves 14 (that is, the wire holding portion 9) hold the respective wires 15 in such a manner that the longitudinal axes of the wires 15 are disposed parallel to the fitting direction K. For holding the wire 15, a diameter of the wire receiving groove 14 is made slightly smaller than the diameter of the wire 15, or a retaining projection or the like for preventing withdrawal of the wire is formed at the wire holding groove 14.

In the outer housing 5 of the above construction, the control circuit package 6 is inserted and received in the housing body 7 through the opening 12, and this control circuit package 6 is located between the housing body 7 and the cover portion 8.

In this embodiment, one wire 15 (hereinafter designated by reference numeral 15*a*) is received and held in two wire receiving grooves 14 (among the plurality of wire receiving grooves 14 of the wire holding portion 9) which are disposed respectively in opposite outermost positions in the direction of the width of the cover portion 8. Also, another wire 15 (hereinafter designated by reference numeral 15*b*) is received and held in two wire receiving grooves 14 which are disposed inwardly of and adjacent to the above outermost wire receiving grooves 14, respectively. Each of the two wires 15*a* and 15*b* is bent into a U-shape within the outer housing 5. One of these wires 15*a* and 15*b* which is disposed outwardly of the other serves as a power wire, and is connected to a power source so as to supply electric power from this power source to an IC chip 17 (described later) of the control circuit package 6. The other wire serves as a grounding wire, and connects the IC chip 17 to the ground.

The two innermost wires 15 (hereinafter designated by reference numeral 15*c*) among the plurality of wires 15 are separated from each other within the outer housing 5. These wires 15 are connected to the switches 30 via the IC chip 17, the mating connector 2, etc., and transmit control signals such as switch signals of the switches 30. Namely, the wires 15*c* are control wires for the switches 30 serving as the electronic devices.

These wires 15*c* are formed originally by the single wire 15 which is held in the two innermost wire receiving grooves 14, and is bent into a U-shape within the outer housing 5 as indicated in dotted lines in FIG. 5, and then is cut at its bent portion 15*d* to provide the wire wires 15*c* separate from each other. As described above, the wire holding portion 9 holds the control wires 15*c* such that these control wires 15*c* are disposed inwardly of the power wire 15*a* and the grounding wire 15*b* in the direction of the width of the outer housing 5.

Figure 7:
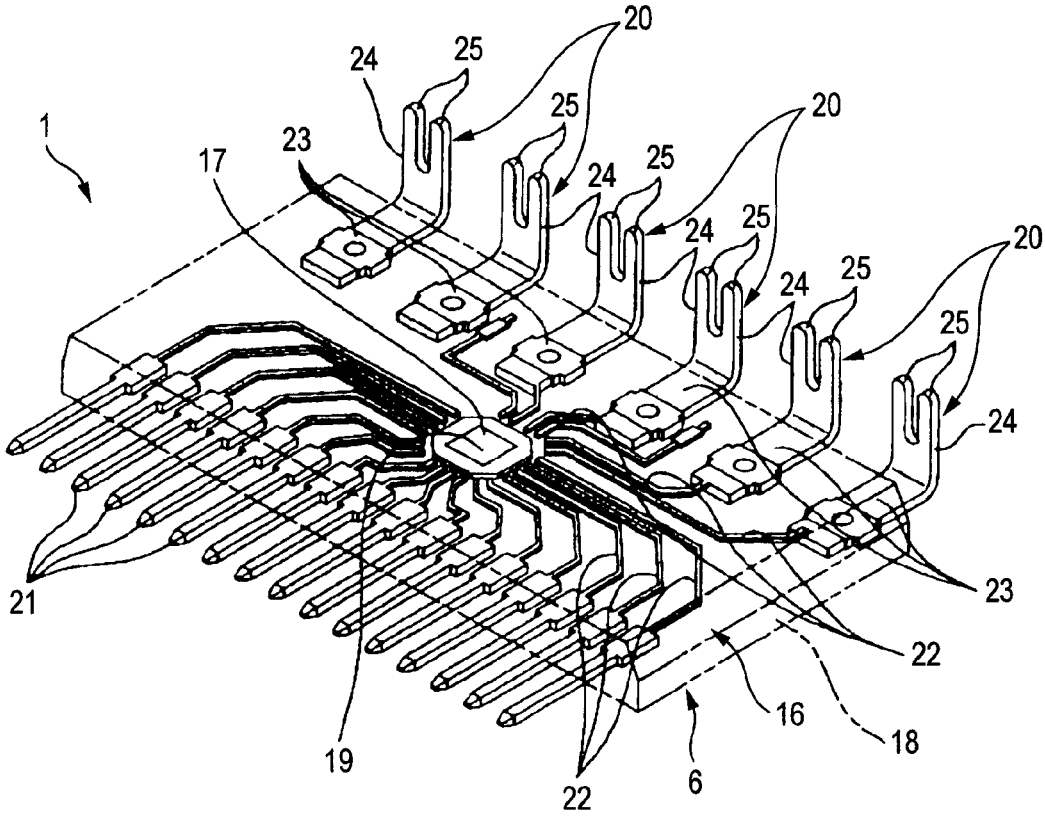
FIG. 7 is a perspective view of a control circuit package of the electronic part-containing connector of FIG. 3.

As shown in FIG. 7, the control circuit package 6 includes a lead frame 16, the IC chip 17 serving as a circuit element, and a resin sealing body 18. The lead frame 16 is made of electrically-conductive metal, and includes a chip holding portion 19, a plurality of press-contacting blades 20, a plurality of male tabs 21 (corresponding to connector connecting portions), and a plurality of interconnecting portions 22, these portions 19, 20, 21 and 22 being formed integrally with one another.

The chip holding portion 19 is formed into a flat plate-like shape. The IC chip 17 is bonded to an outer surface of the chip holding portion 19 by an epoxy adhesive, an Ag paste, soldering or other means. The press-contacting blades 20 are arranged at predetermined intervals. The press-contacting blades 20 are equal in number to the wire receiving grooves 14.

The press-contacting blade 20 includes a parallel portion 23, and an upstanding portion 24 formed integrally with the parallel portion 23. The parallel portion 23 has a strip-like shape, and opposite sides (or faces) of the parallel portion 23 are disposed coplanar with opposite sides (or faces) of the chip holding portion 19, respectively. The parallel portions 23 of the plurality of press-contacting blades 20 are arranged parallel to one another. The parallel portions 23 of the plurality of press-contacting blades 20 are spaced from the chip holding portion 19.

The upstanding portion 24 of the press-contacting blade 20 extends upwardly from that end of the parallel portion 23 remote from the chip holding portion 19. In the illustrated embodiment, opposite sides (or faces) of the upstanding portion 24 are perpendicular to the opposite sides of the parallel portion 23. The opposite sides of the upstanding portion 24 are parallel to a direction in which the cover portion 8 is moved toward the housing body 7 when the cover portion 8 is to be attached to the housing body 7.

The upstanding portions 24 of the plurality of press-contacting blades 20 extend upwardly from the respective parallel portions 23 in the same direction. A slit 25 is formed in the upstanding portion 24, and extends from a distal end edge thereof (remote from the parallel portion 23) toward the parallel portion 23. When the wire 15 (15*a*, 15*b* or 15*c*) is press-fitted into the slit 25 in the upstanding portion 24 of the press-contacting blade 20, the press-contacting blade 20 cuts the sheath of the wire 15, and contacts the core wire of the wire 15. Thus, the upstanding portion 24 (that is, the press-contacting blade 20) is press-contacted with the wire 15 (15*a*, 15*b* or 15*c*).

The male tab 21 is formed into a linearly extending bar-like shape. The plurality of male tabs 21 are arranged in parallel spaced relation to one another. The chip holding portion 19 is disposed between the plurality of male tabs 21 and the plurality of press-contacting blades 20. When the control circuit package 6 is received in the outer housing 5, longitudinal axes of the male tabs 21 are disposed parallel to the fitting direction K, and are connected respectively to the metal terminals of the mating connector 2 fitted in the hood portion 10.

The interconnecting portions 22 are bent, and extend from the press-contacting blades 20 and the male tabs 21 to the chip holding portion 19. Part of the interconnecting portions 22 respectively connect the press-contact blades 20 to the chip holding portion 19, while the other interconnecting portion 22 respectively connect the male tabs 21 to the chip holding portion 19.

The IC chip 17 is disposed on the chip holding portion 19, and therefore is mounted on the lead frame 16. The IC chip 17 is connected to the interconnecting portions 22 by well-known bonding wires. The IC chip 17 electrically connects the press-contacting blades 20 to the male tabs 21 via the interconnecting portions 22 in a predetermined pattern. The IC chip 17 is thus mounted on the lead frame 16.

The resin sealing body 18 is made of a synthetic resin, and is formed into a flattened box-like shape. For forming the resin sealing body 18, the chip holding portion 19, the parallel portions 23 of the press-contacting blades 20, proximal end portions of the male tabs 21 close to the chip holding portion 19 and the interconnecting portions 22 are received in a mold, and then a molten synthetic resin is poured into this mold, thereby molding the resin sealing body 18 sealing these portions. Namely, the resin sealing body 18 covers and seals the IC chip 17 and the central portion of the lead frame 16. Thus, the resin sealing body 18 seals the IC chip 17 and the lead frame 16 in such a manner that the press-contacting blades 20 and the male tabs 21 are exposed.

The connector 1 of the above construction is assembled in the following manner. First, the wires 15, 15*a* and 15*b* are held on the wire holding portion 9 of the cover portion 8 by the worker, and these wires 15, 15*a* and 15*b* are installed such that each wire assumes a U-shape. Then, the innermost wire 15 is cut or severed at its bent portion 15*d* to provide the wires 15*c*.

Then, the control circuit package 6 is inserted into the housing body 7 through the opening 12. At this time, the male tabs 21 are located in the hood portion 10, and the upstanding portions 24 (that is, the press-contacting blades 20) are located in the control circuit package-receiving chamber 11 to extend upwardly away from the bottom wall 11*a*.

Then, as the cover portion 8 is gradually moved toward the opening 12, the wires 15*a*, 15*b* and 15*c* held respectively in the wire holding grooves 14 of the wire holding portion 9 are gradually inserted respectively into the slits 25 of the upstanding portions 24 of the press-contacting blades 20.

Then, the engagement portions 13*b* are engaged respectively with the engagement portions 13*a*, and the cover portion 8 is attached to the housing body 7 to completely close the opening 12, so that the wires 15*a*, 15*b* and 15*c* are press-fitted respectively in the slits 25, and the press-contacting blades 20 cut the sheaths of the respective wires 15*a*, 15*b* and 15*c*, and contact the respective core wires.

Figure 8:
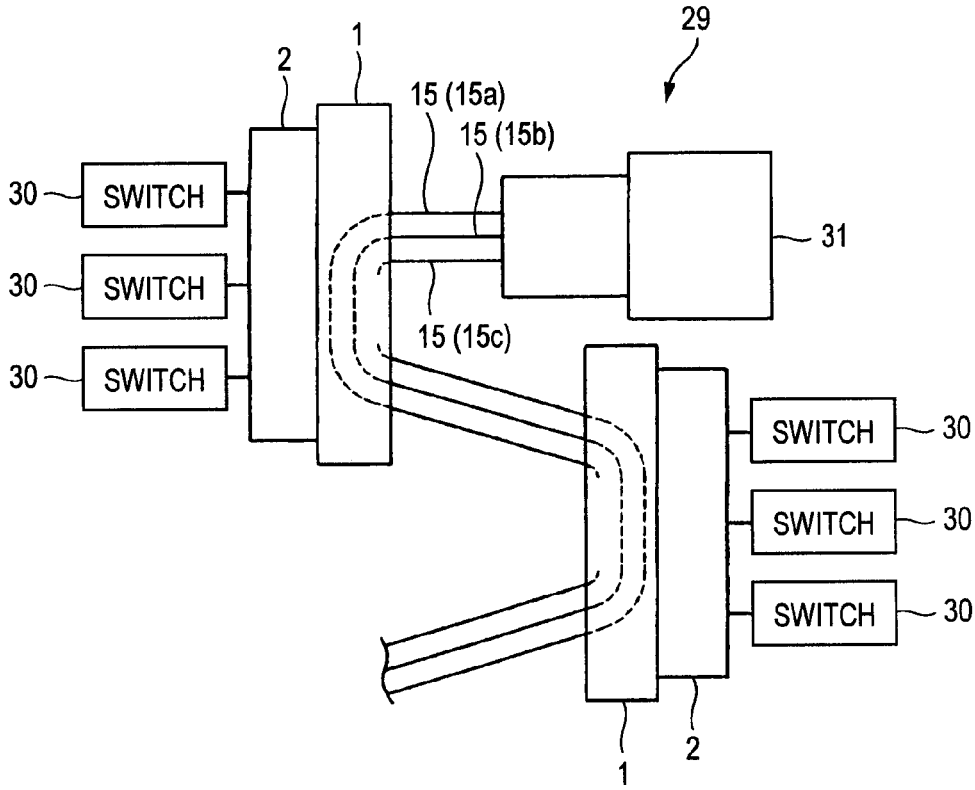
FIG. 8 is an illustration showing the construction of a wire harness provided with the electronic part-containing connectors shown in FIG. 1.
Figure 9:
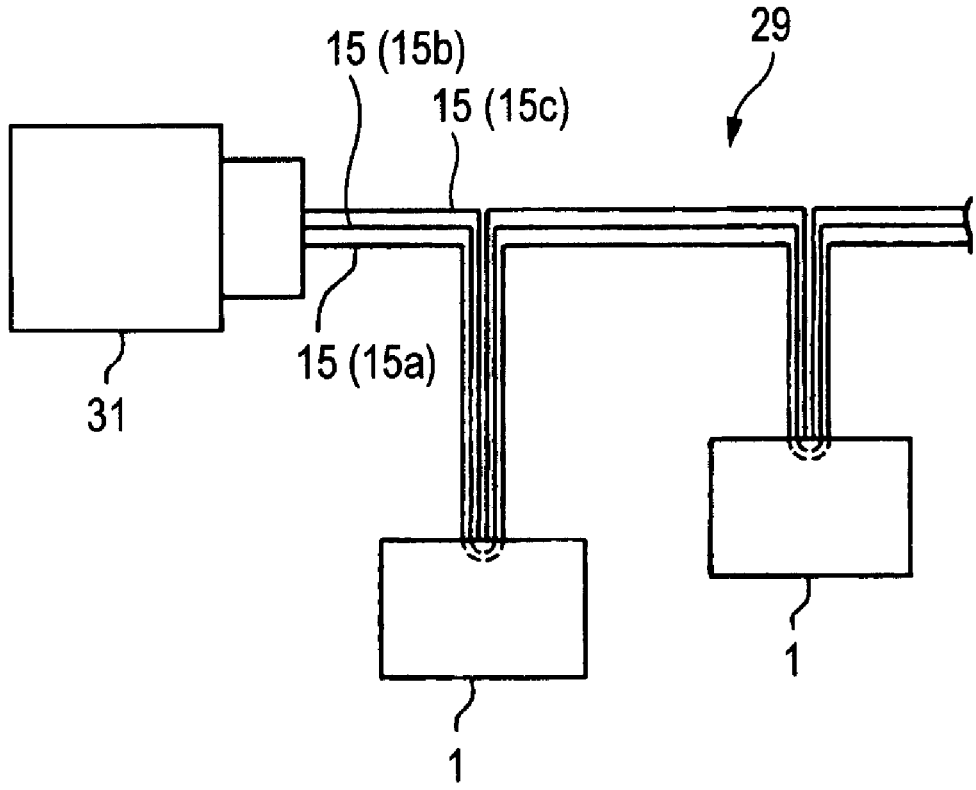
FIG. 9 is a plan view showing the construction of the wire harness of FIG. 8.
Figure 10:
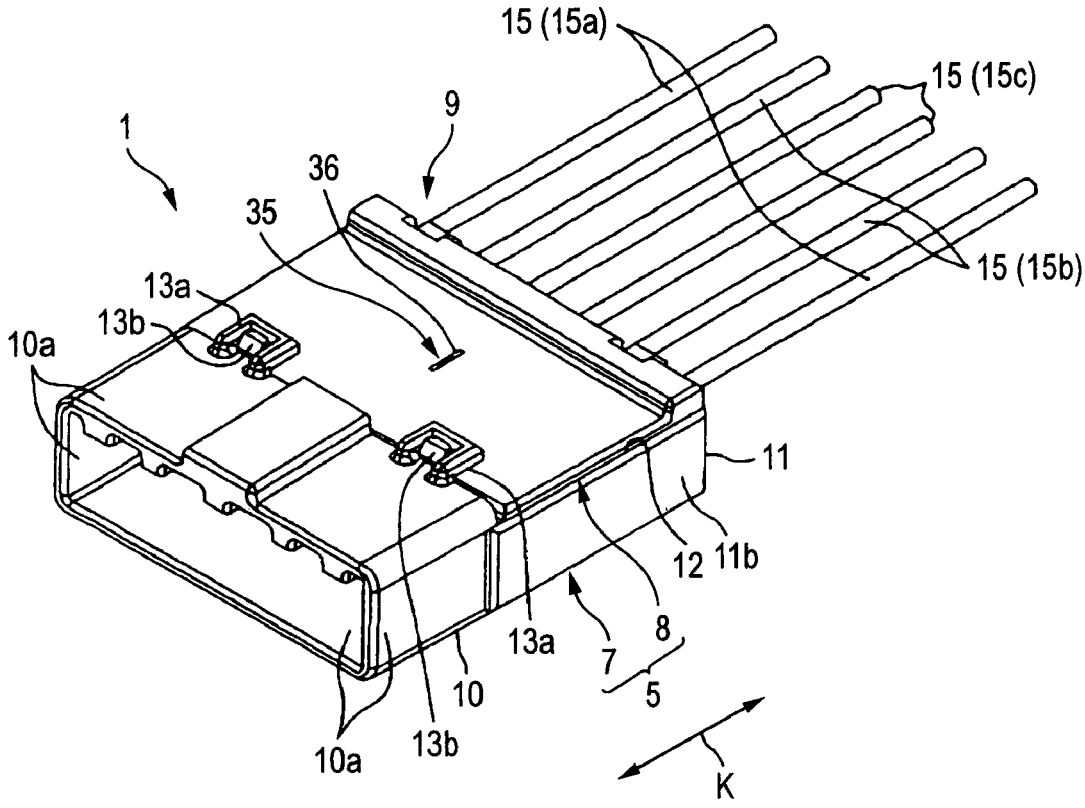
FIG. 10 is a perspective view of a modified example of the electronic part-containing connector of FIG. 3.
Figure 11:
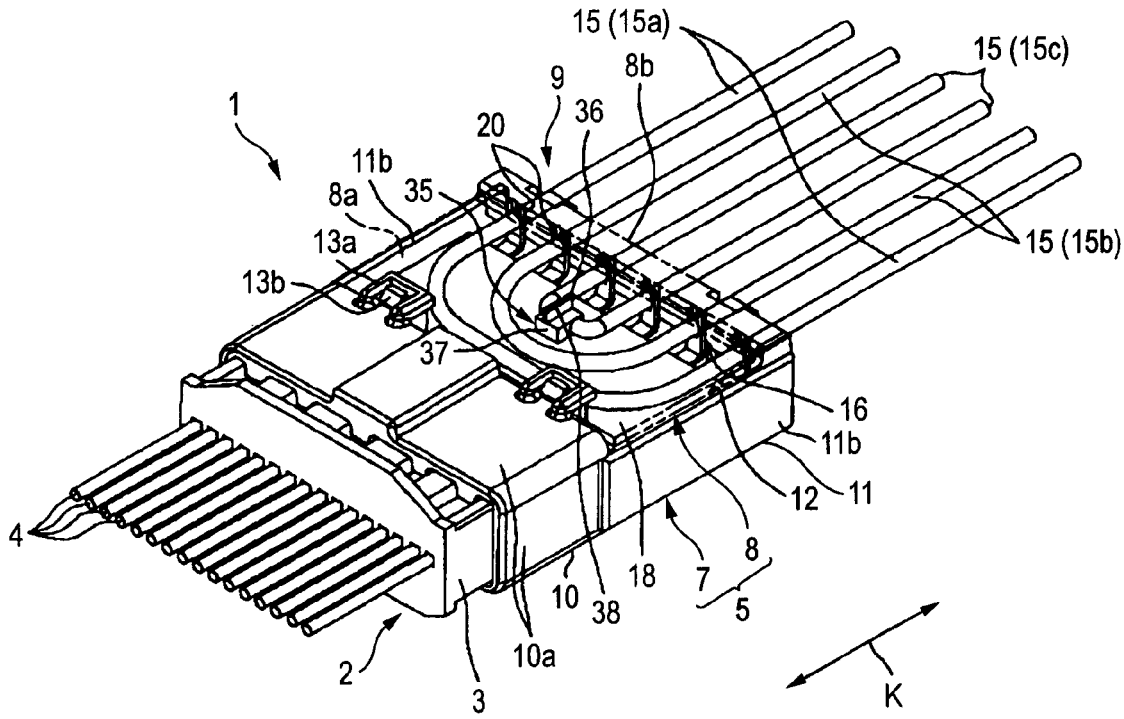
FIG. 11 is a perspective view of the electronic part-containing connector of FIG. 10.
Figure 12:
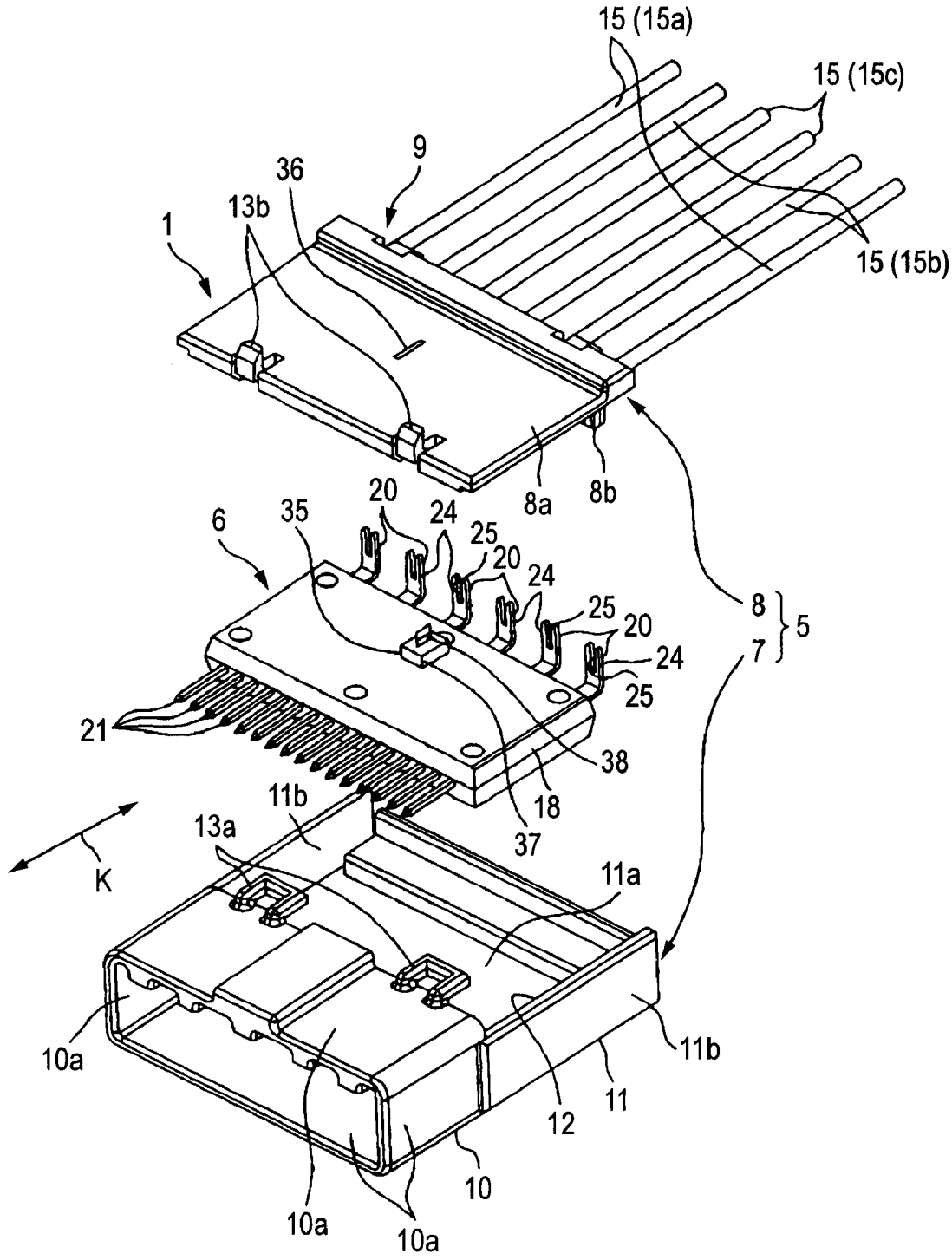
FIG. 12 is an exploded perspective view of the electronic part-containing connector of FIG. 10.
Figure 13:
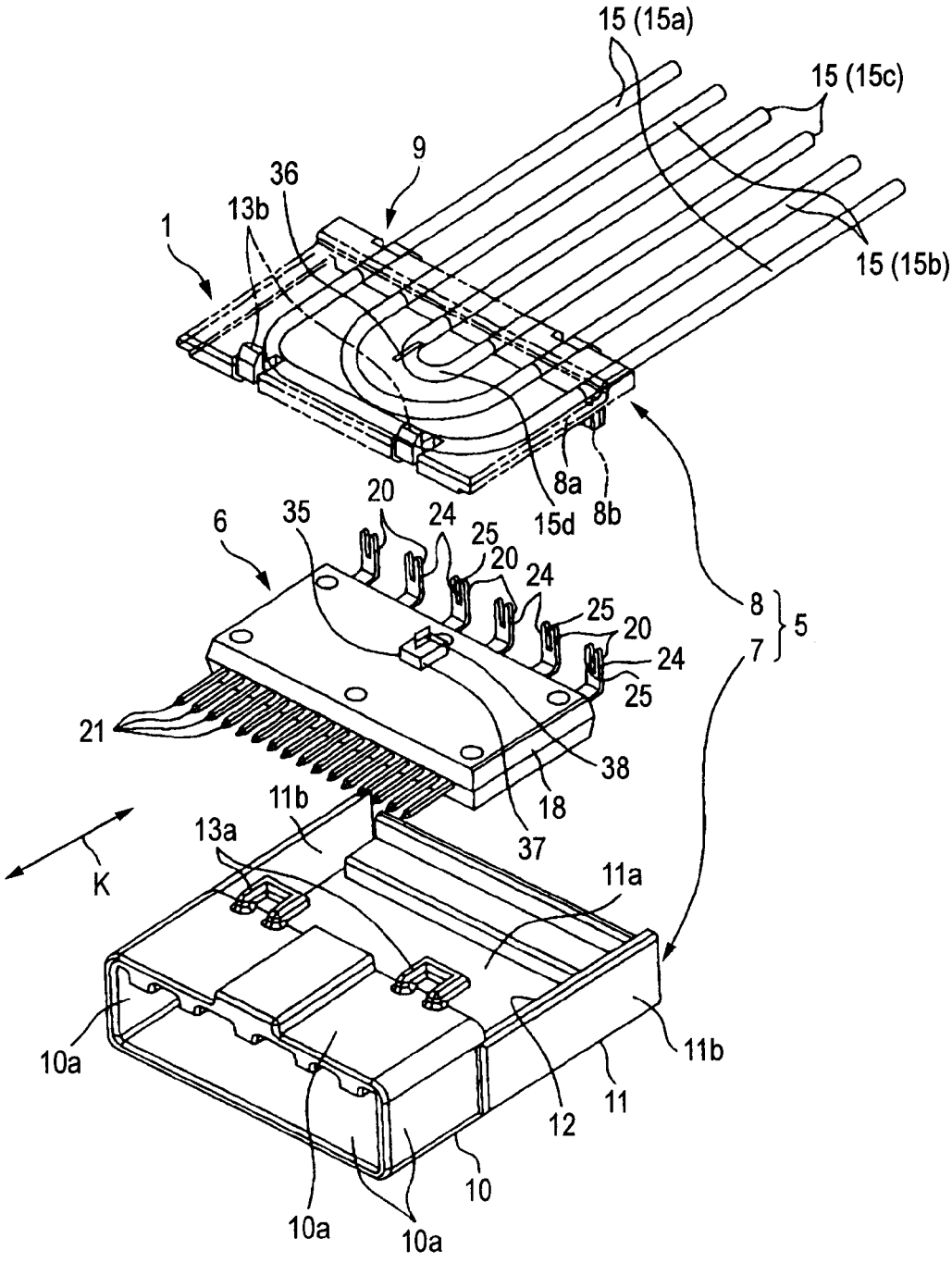
FIG. 13 is a perspective view of a cover portion of the electronic part-containing connector of FIG. 12.
Figure 14:
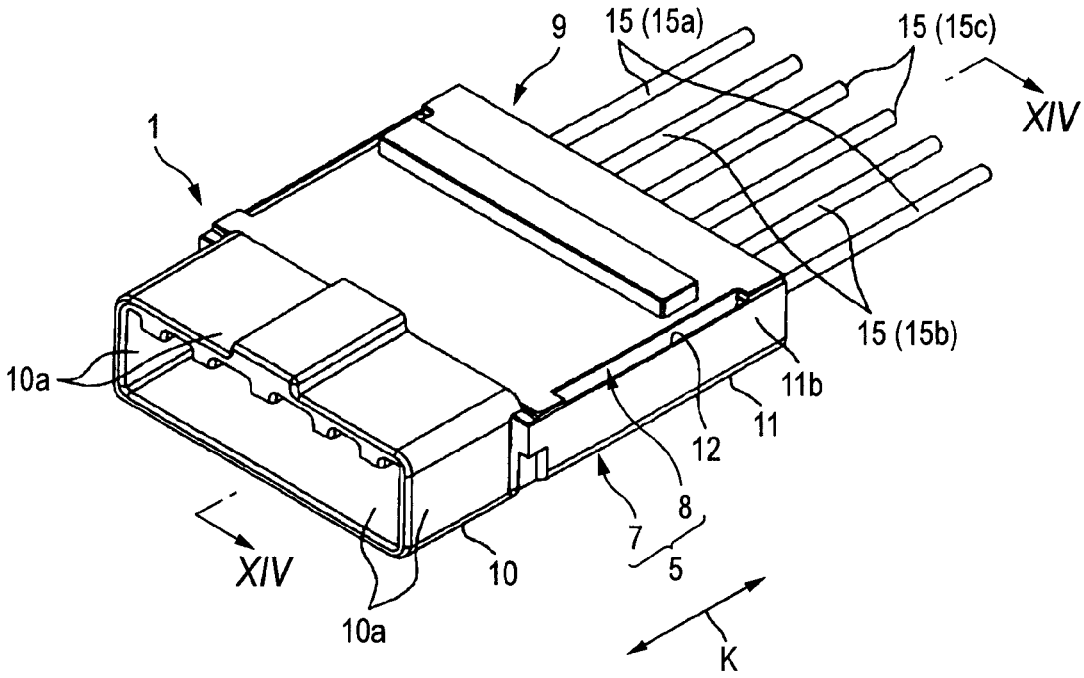
FIG. 14 is a perspective view of another modified example of the electronic part-containing connector of FIG. 1.

The connector 1 of the above construction is assembled in this manner. In the thus assembled connector 1, the wires 15*a*, 15*b* and 15*c* are led out from the rear side of the outer housing 5 when viewed from the front side of the hood portion 10 for fitting to the mating connector 2 as well as in a conventional ordinary connector which does not contain the IC chip 17, etc., and is formed by metal terminals and a housing. The connector 1 is fitted to the mating connector 2 to form a wire harness 29 as shown in FIGS. 8 and 9.

In the wire harness 29, an electric connection box 31 is connected to ends of the wires 15*a*, 15*b* and 15*c* via the connector 1. In the wire harness 29, electric power is supplied from the power source to the IC chip 17 via the power wire 15*a*, and switch signals of the switches 30 connected to the mating connector 2 are transmitted to the electric connection box 31 via the IC chip 17 and the control wires 15*c*. Thus, in the connector 1, the IC chip 17 connects the wires 4 (connected to the mating connector 2) to the wires 15*a*, 15*b* and 15*c*, press-contacted with the respective press-contacting blades 20, in the predetermined pattern.

For disassembling the assembled connector 1, first, the worker separates the wires 15*a*, 15*b* and 15*c* from the housing body 7, and removes these wires 15*a*, 15*b* and 15*c* from the housing body 7. At this time, the wires 15*a*, 15*b* and 15*c* are disconnected or disengaged respectively from the press-contacting blades 20, and also the engagement portions 13*b* are disengaged respectively from the engagement portions 13*a*, and the cover portion 8 is removed, together with the wires 15*a*, 15*b* and 15*c*, from the housing body 7. Then, the control circuit package 6 is removed from the control circuit package-receiving chamber 11 of the housing body 7 through the opening 12. The connector 1 is easily disassembled in this manner.

In this embodiment, the wire holding portion 9 is provided at that side of the outer housing 5 disposed rearwardly of the hood portion 10 for fitting the mating connector 2, and holds the wires 15*a*, 15*b* and 15*c* in such a manner these wires 15*a*, 15*b* and 15*c* extend in the direction K of fitting of the mating connector 2, and therefore the connector 1 can be handled in a similar manner to an ordinary connector not containing the IC chip 17.

Therefore, as shown in FIGS. 8 and 9, the connector 1 can be disposed at the ends of the wires 15*a*, 15*b* and 15*c*, that is, at ends of branch wires of the wire harness 29. Therefore, even when the wire harness 29 provided with the connectors 1 is combined with a wire harness provided with ordinary connectors, such combined wire harnesses can be installed on an automobile or the like in a similar manner to a wire harness provided with the ordinary connectors. Therefore, the connectors 1, when assembled into the wire harness 29, can be used in a similar manner to the conventional ordinary connector, and therefore can be easily handled.

Furthermore, the wire holding portion 9 is provided at the cover portion 8, and therefore the wires 15*a*, 15*b* and 15*c* are held on the wire holding portion 9, and then the cover portion 8 is attached to the housing body 7, and merely by doing so, the connector 1 can be assembled. Therefore, the connector 1 can be easily assembled. Furthermore, by separating the wires 15*a*, 15*b* and 15*c* from the housing body 7, the cover portion 8 can be removed from the housing body 7, and therefore the connector 1 can be easily disassembled.

Furthermore, the control circuit package 6 includes the press-contacting blades 20, and therefore this control circuit package 6 can be easily connected to the wires 15*a*, 15*b* and 15*c*. Therefore, the connector 1 can be assembled more easily. Furthermore, the connection between the control circuit package 6 and the wires 15*a*, 15*b* and 15*c* can be easily canceled, and therefore the connector 1 can be disassembled more easily.

Furthermore, each of the power wire 15*a* and the grounding wire 15*b* is bent into a U-shape within the outer housing 5, and therefore the power wire 15*a* and the grounding wire 15*b* can be used in common between the plurality of connectors 1 of the wire harness 29, and therefore the increase of the number of the wires 15*a*, 15*b* and 15*c* forming the wire harness 29 can be suppressed.

Furthermore, the control wires 15*c* provided by cutting the wire 15 at the bent portion 15*d* are disposed closer to the central portion of the outer housing than the power wire 15*a* and the grounding wire 15*b* are, and therefore the radius of curvature of each of the power wire 15*a* and the grounding wire 15*b* can be made large, and besides the control wires 15*c* separated from each other by cutting the bent portion 15*d* can be disposed close to each other.

Thus, the radius of curvature of each of the power wire 15*a* and the grounding wire 15*b* can be made large, and therefore the power wire 15*a* and the grounding wire 15*b* can be prevented from being accidentally cut. And besides, since the control wires 15*c* separated from each other by cutting the bent portion 15*d* can be disposed close to each other, the outer housing 5 and hence the connector 1 itself can be formed into a compact design.

In the above embodiment, the worker cuts the bent portion 15*d* of the wire 15 held in the innermost wire receiving grooves 14 and installed into the U-shape. However, in the invention, the connector 1 may be modified to include a cutting portion 35 for cutting the bent portion 15*d* of the wire 15 held in the innermost wire receiving grooves 14 and installed into the U-shape, as shown in FIGS. 10 to 13. In this modified example shown in FIGS. 10 to 13, those portions identical to those of the above embodiment will be designated by the identical reference numerals, respectively, and description thereof will be omitted.

In the modified example shown in FIGS. 10 to 13, the connector 1 includes the cutting portion 35 provided at the control circuit package 6, and a cutting reception portion 36 provided at the cover portion 8. As shown in FIGS. 10 to 13, the cutting portion 35 includes a cutting portion body 37, and a cutting blade 38. The cutting portion body 37 has a square shape, and is formed integrally on and projects from an outer surface of the resin sealing body 18. The cutting portion body 37 is so positioned as to correspond to the bent portion 15*d* of the wire 15 held in the innermost wire receiving grooves 14 of the wire holding portion 9 provided at the cover portion 8.

The cutting blade 38 is made of metal, and is formed into a blade shape. The cutting blade 38 extends upwardly from the cutting portion body 37, and opposite sides (or faces) of the cutting blade 38 are disposed parallel to those portions of the wires 15*a*, 15*b* and 15*c* extending outwardly from the connector 1. The cutting blade 38 is formed on the resin sealing body 18 and the cutting portion body 37 by insert molding or other method. When attaching the cover portion 8 to the housing body 7, the cutting blade 38 is brought into abutting engagement with the bent portion 15*d* of the wire 15 held in the innermost wire receiving grooves 14 of the wire holding portion 9, and cuts this bent portion 15*d*.

The cutting blade 38 of the cutting portion 35 cuts the bent portion 15*d* of the wire 15 when attaching the cover portion 8 to the housing body 7, and the cutting portion body 37 is inserted between the wires 15*c* separated from each other as a result of cutting the bent portion 15*d* of the wire 15, and insulates these wires 15*c* from each other.

The cutting reception portion 36 has a slit-like shape, and is formed through the top wall 8*a* of the cover portion 8. When the cover portion 8 is attached to the housing body 7, the cutting reception portion 36 receives a distal end portion of the cutting blade 38, thereby preventing this cutting blade 38 from being damaged or broken.

In the modified example shown in FIGS. 10 to 13, in addition to the advantages of the above embodiment, there is provided the cutting portion 35 for cutting the bent portion 15*d* of the control wire 15, and therefore in the assembled condition of the wire harness 29, the control wires 15*c* are electrically insulated from each other between the plurality of connectors 1. Therefore, even with the use of a simple communication system, the wire harness 29 can transmit desired control information without inviting a crossed line.

Furthermore, the cutting portion 35 is provided at the control circuit package 6, the bent portion 15*d* of the control wire 15*c* can be positively cut by the cutting portion 35 when attaching the cover portion 8 to the housing body 7. Therefore, merely by attaching the cover portion 8 to the housing body 7, the bent portion 15*d* of the control wire 15*c* can be cut. Therefore, the connector 1 can be assembled more easily.

In the above embodiment, the wire holding portion 9 includes the plurality of wire receiving grooves 14 formed in the rear wall 8*b* of the cover portion 8, and the wires 15*a*, 15*b* and 15*c* are held by the plurality of wire receiving grooves 14 to extend in the direction K of fitting of the mating connector 2, and also each of the wires 15*a* and 15*b* is bent into a U-shape within the outer housing 5. However, in the invention, the connector 1 may be modified such that a wire holding portion 9 includes parallel portions 41 formed on a top wall 8*a* of a cover portion 8, and intersecting portions 42 provided at a rear wall 8*b* of the cover portion 8, and wires 15*a*, 15*b* and 15*c* are installed on an inner surface of the cover portion 8 in such a manner that these wires 15*a*, 15*b* and 15*c* are bent into an L-shape by the corresponding parallel portions 41 and intersecting portions 42 as shown in FIGS. 14 to 18. In the modified example shown in FIGS. 14 to 18, those portions identical to those of the above embodiment will be designated by the identical reference numerals, respectively, and description thereof will be omitted.

In the modified connector 1 shown in FIGS. 14 to 18, the wire holding portion 9 includes the parallel portions 41 formed at the top wall 8*a* of the cover portion 8, and the intersecting portions 42 formed at the rear wall 8*b*. The parallel portions 41 are formed at the inner surface of the top wall 8*a*, and each parallel portion 41 is in the form of a groove of a channel-shaped cross-section recessed from the inner surface of the top wall 8*a*. The plurality of parallel portions 41 are spaced from one another in a direction of a width of the cover portion 8. The wires 15*a*, 15*b* and 15*c* are passed respectively through the plurality of parallel portions 41, and therefore are held respectively in these parallel portions 41 in such a manner that the wires 15*a*, 15*b* and 15*c* are disposed in parallel contiguous relation to the top wall 8*a*.

Figure 15:
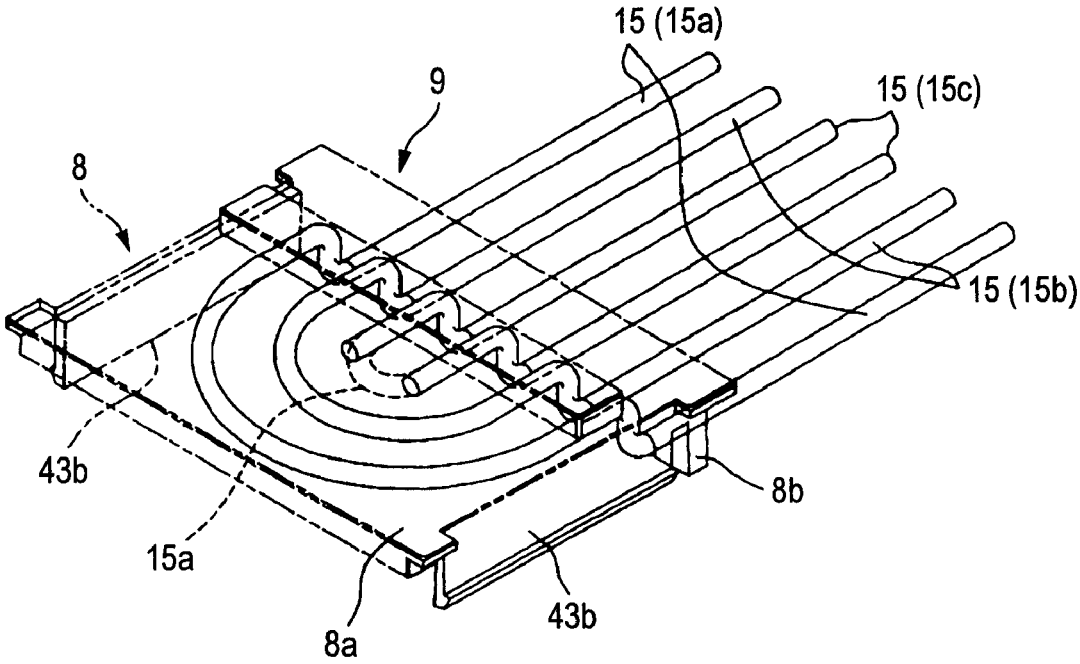
FIG. 15 is a perspective view of a cover portion of the electronic part-containing connector of FIG. 14.
Figure 16:
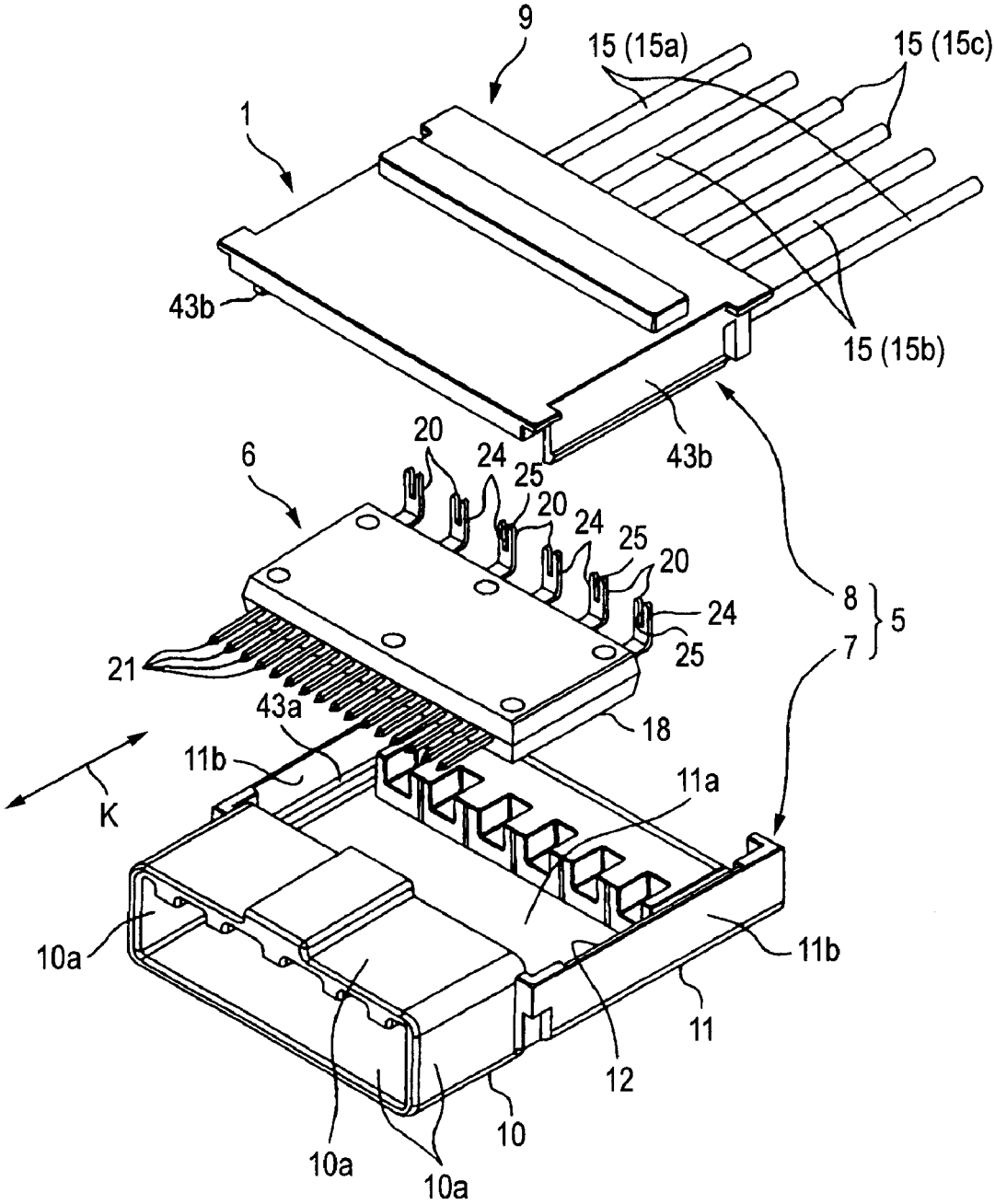
FIG. 16 is an exploded perspective view of the electronic part-containing connector of FIG. 14.
Figure 17:
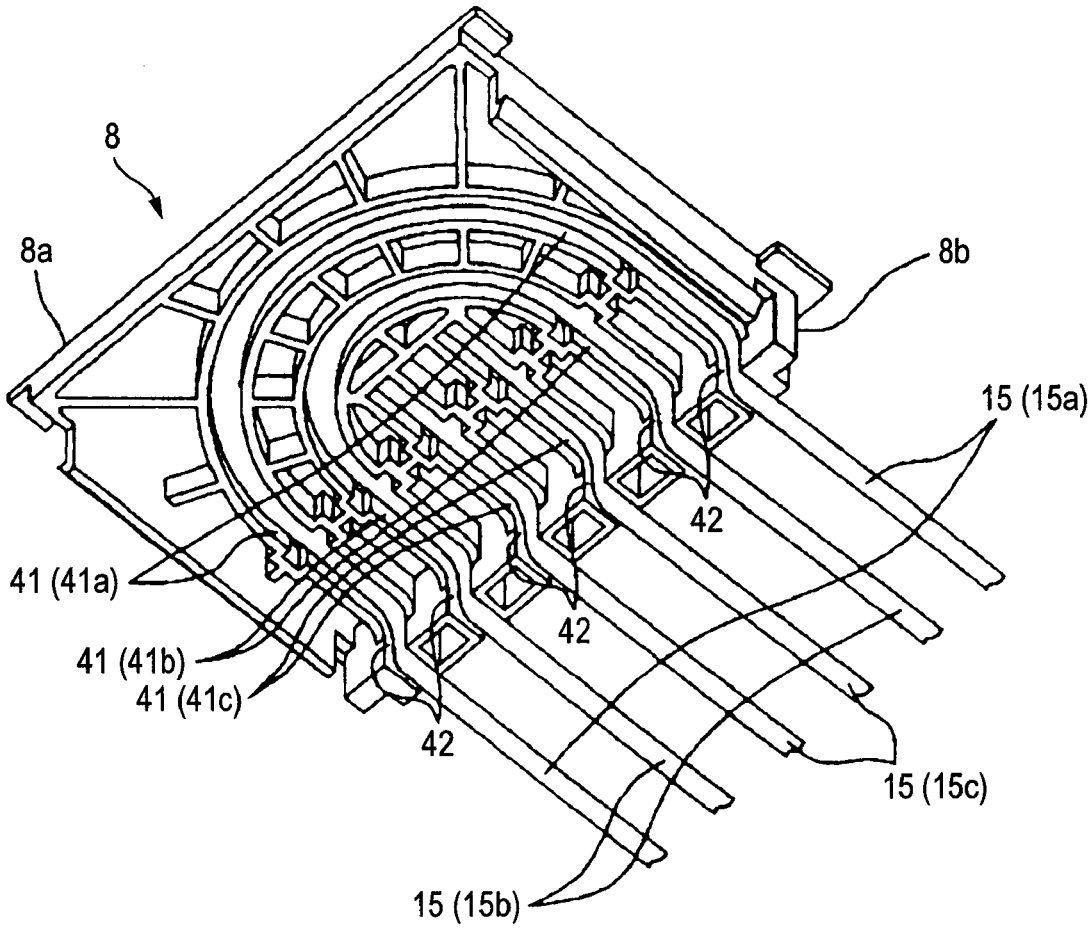
FIG. 17 is a perspective view showing an inner surface of the cover portion of FIG. 15.

Among the plurality of parallel portions 41, two parallel portions 41 (hereinafter designated by reference numeral 41*a*) which are disposed respectively in opposite outermost positions in the direction of the width of the cover portion 8 extend to be connected with each other to form an arc-shaped portion convexly curved in a direction away from the rear wall 8*b* of the cover portion 8, thereby providing the continuous parallel portion 41*a* as shown in FIGS. 15 and 17. Also, two parallel portions 41 (hereinafter designated by reference numeral 41*b*) which are disposed inwardly of and adjacent to the above outermost parallel portions 41, respectively, extend to be connected with each other to form an arc-shaped portion convexly curved in a direction away from the rear wall 8*b* of the cover portion 8, thereby providing the continuous parallel portion 41*b*. Namely, each of the parallel portions 41*a* and 41*b* has a U-shape when viewed in a direction perpendicular to the inner surface of the cover portion 8. The parallel portions 41*a* and 41*b* hold the wires 15*a* and 15*b*, respectively, in such a manner that these wires 15*a* and 15*b* are bent into a U-shape, and are disposed in parallel contiguous relation to the top wall 8*a*.

As shown in FIGS. 15 and 17, the two innermost parallel portions 41 (hereinafter designated by reference numeral 41*c*) among the plurality of parallel portions 41 extend straight from a generally central portion of the top wall 8*a* to the rear wall 8*b*. These parallel portions 41*c* hold the wires 15*c*, respectively, in such a manner that these wires 15*c* are disposed in parallel contiguous relation to the top wall 8*a* of the cover portion 8.

Figure 18:
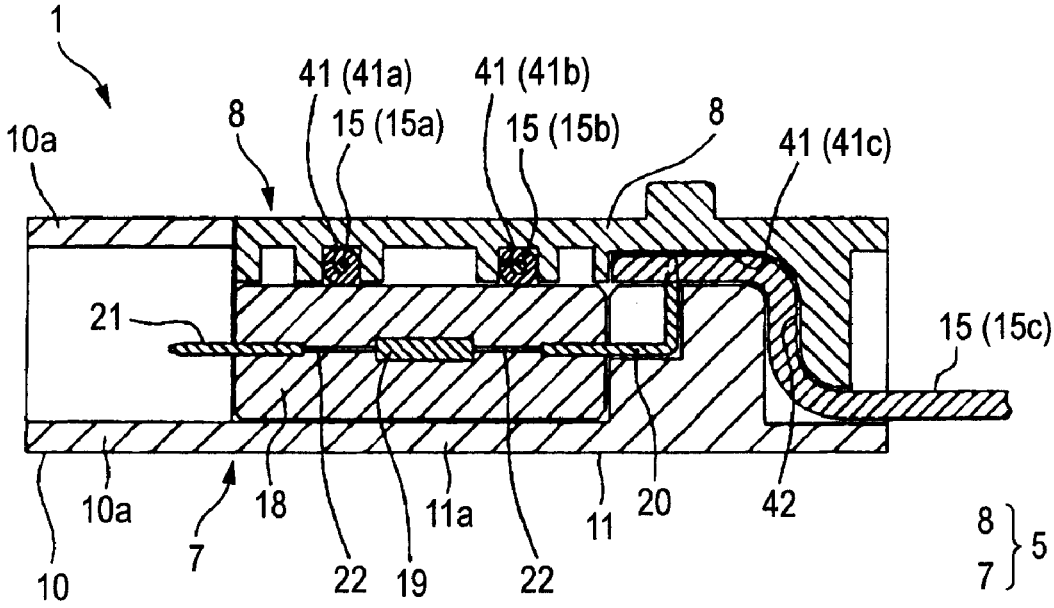
FIG. 18 is a cross-sectional view taken along the line XIV-XIV of FIG. 14.

As shown in FIGS. 17 and 18, the intersecting portions 42 are formed at an inner surface of the rear wall 8*b* of the cover portion 8, and extend from the top wall 8*a* toward a housing body 7, each intersecting portion 42 being in the form of a groove of a channel-shaped cross-section recessed from the inner surface of the rear wall 8*b*. The plurality of intersecting portions 42 are spaced from one another in the direction of the width of the cover portion 8. The plurality of intersecting portions 42 are continuous with the plurality of the parallel portions 41, respectively. The wires 15*a*, 15*b* and 15*c* are passed through the corresponding intersecting portions 42, and therefore the intersecting portions 42 hold the wires 15*a*, 15*b* and 15*c* in such a manner that the wires 15*a*, 15*b* and 15*c* extend perpendicularly from the respective parallel portions 41 in intersecting relation thereto, and are disposed in contiguous relation to the rear wall 8*b*.

In the wire holding portion 9, the plurality of parallel portions 41 hold the wires 15*a*, 15*b* and 15*c* in such a manner that these wires 15*a*, 15*b* and 15*c* are disposed in parallel contiguous relation to the top wall 8*a*, and the plurality of intersecting portions 42 hold the wires 15*a*, 15*b* and 15*c* in such a manner that these wires 15*a*, 15*b* and 15*c* extend perpendicularly from the respective parallel portions 41 in intersecting relation thereto, and are disposed in contiguous relation to the rear wall 8*b*, and therefore the wires 15*a*, 15*b* and 15*c* are installed on the inner surface of the cover portion 8 in such a manner that each of these wires 15*a*, 15*b* and 15*c* is bent into an L-shape.

In this modified connector 1, engagement portions 43*a* and engagement portions 43*b* which engages with each other are provided at the housing body 7 of the outer housing 5 and the cover portion 8. The engagement portions 43*a* are provided at the housing body 7, and are formed respectively on inner surfaces of a pair of opposed side walls 11*b* of a control circuit package-receiving chamber 11, and project toward each other. Each engagement portion 43*a* is in the form of a rib of a triangular cross-section, and is formed on a lower portion of the side wall 11*b* disposed adjacent to a bottom wall 11*a*, and extends along the side wall 11*b* in spaced relation to the bottom wall 11*a*.

The engagement portions 43*b* are provided at the cover portion 8, and each of the engagement portions 43 has a flat plate-like shape. The engagement portions 43*b* are formed respectively on opposite side edge portions of the top wall 8*a* spaced from each other in a direction perpendicular to a fitting direction K, and project perpendicularly therefrom toward the housing body 7. Distal end portions of the two engagement portions 43*b* are directed outwardly, that is, away from each other, so that the distal end portion of each engagement portion 43*b* has a hook-like shape. When the cover portion 8 is attached to the housing body 7, the hook-like distal end portions of the engagement portions 43*b* slide respectively over the engagement portions 43*a*, and are engaged with these engagement portions 43*a*, respectively.

In the modified example shown in FIGS. 14 to 18, the wire holding portion 9 includes the parallel portions 41 for holding the wires 15*a*, 15*b* and 15*c* in parallel contiguous relation to the top wall 8*a*, and the intersecting portions 42 for holding the wires 15*a*, 15*b* and 15*c* in such a manner that these wires 15*a*, 15*b* and 15*c* extend perpendicularly from the respective parallel portions 41 in intersecting relation thereto, and are disposed in contiguous relation to the rear wall 8*b*, and therefore the wires 15*a*, 15*b* and 15*c* are installed on the inner surface of the cover portion 8 in such a manner that each of these wires 15*a*, 15*b* and 15*c* is bent into an L-shape.

Therefore, when a load acts on the wires 15*a*, 15*b* and 15*c*, this load can be received by the rear wall 8*b* of the cover portion 8, and therefore a load acting on the contact portions between the control circuit package 6 and the wires 15*a*, 15*b* and 15*c* can be reduced. Therefore, incomplete connection between the control circuit package 6 and the wires 15*a*, 15*b* and 15*c* can be suppressed.

Furthermore, each of the parallel portions 41 as well as each of the intersecting portions 42 is in the form of the channel-shaped groove recessed from the inner surface of the cover portion 8, and therefore the wires 15*a*, 15*b* and 15*c* are less liable to be disengaged from the cover portion 8. Therefore, by separating the wires 15*a*, 15*b* and 15*c* from the housing body 7, the cover portion 8 can be positively removed from the housing body 7.

In the above embodiment and the modified examples, the lead frame 16 has the male tabs 21 for connection to the metal terminals of the mating connector 2. However, in the invention, female terminals may be used for connection to the metal terminals of the mating connector 2. In short, metal terminals of any suitable construction can be used in so far as they can be connected to the metal terminals of the mating connector 2.

In the above embodiment and the modified examples, the resin sealing body 18 of the control circuit package 6 is formed into the flattened box-like shape. However, in the invention, the resin sealing body 18 may be formed into a hollow box-like shape to cover the lead frame 16, the IC chip 17, etc.

In the above embodiment and the modified examples, the control circuit package 6 includes the lead frame 16, and the IC chip 17 mounted on the lead frame 16. However, in the invention, the control circuit package 6 may include a printed circuit board, and electronic elements mounted on the printed circuit board as in a conventional electronic unit. Furthermore, in the invention, the control wire 15 may not be cut to provide the two separate wires 15*c*, and instead this wire 15 may be used as a single wire, in which case this wire is bent into a U-shape within the outer housing 5.

The above embodiment merely shows a representative example of the invention, and the invention is not limited to the above embodiment. Namely, various modifications can be made without departing from the subject matter of the invention.

What is claimed is:

1. A connector, comprising:

a control circuit portion having a circuit element; and a housing including:

a fitting portion which fits to a mating connector;

a receiving chamber which receives the control circuit portion; and a wire holding portion which holds wires connected to the control circuit portion, wherein the wire holding portion is provided on the opposite side of the fitting portion; and wherein the wire holding portion holds the wires so that the wires extend in a fitting direction in which the housing fits to the mating connector; and wherein the wire holding portion holds the wires so that at least one of the wires are bent into a generally U-shape within the housing.

2. The connector according to claim 1, wherein the housing includes:

a housing body having an opening through which the control circuit portion is received in the receiving chamber; and a cover portion attached to the housing body to close the opening; and wherein the wire holding portion is provided on the cover portion.

3. The connector according to claim 1, wherein the control circuit portion includes press-contacting blades which are connected in a press-contacting manner respectively to the wires.

4. The connector according to claim 1, wherein the control circuit portion is capable of controlling an electronic device.

5. The connector according to claim 1, wherein the circuit element is an IC chip.

6. A wire harness wherein the wire harness is provided with a plurality of the connectors according to claim 1.

7. The connector according to claim 1, wherein the wires include a power wire for supplying electric power to the circuit element.

8. The connector according to claim 7, wherein the wire holding portion holds the power wire so that the power wire is bent into a generally U-shape within the housing.

9. The connector according to claim 1, wherein the wires include a power wire for supplying electric power to the circuit element, and a grounding wire connected to the ground; and wherein the wire holding portion holds the power wire and the grounding wire so that the power wire and the grounding wire are bent into a generally U-shape within the housing.

10. The connector according to claim 9, wherein the wires include a control wire for controlling an electronic device; and wherein the connector further comprises a cutting portion which cuts a bent portion of the control wire bent into a generally U-shape within the housing.

11. The connector according to claim 10, wherein a central portion of the wire holding portion in a direction perpendicular to the fitting direction is closer to the control wire than the power wire and the grounding wire.

12. The connector according to claim 10, wherein the cutting portion is provided on the control circuit portion.

13. A connector, comprising:

a control circuit portion having a circuit element; and a housing including;

a fitting portion which fits to a mating connector;

a receiving chamber which receives the control circuit portion; and a wire holding portion which holds wires connected to the control circuit portion, wherein the wire holding portion is provided on the opposite side of the fitting portion; and wherein the wire holding portion holds the wires so that the wires extend in a fitting direction in which the housing fits to the mating connector;

wherein the housing includes:

a housing body having an opening through which the control circuit portion is received in the receiving chamber; and a cover portion attached to the housing body to close the opening;

wherein the wire holding portion is provided on the cover portion; and wherein the cover portion includes:

a body portion; and an upstanding wall extending perpendicularly from the body portion toward an inner surface of the housing body;

wherein the wire holding portion includes:

parallel portions which hold the wires in parallel contiguous relation to the body portion; and intersecting portions which hold the wires so that the wires extend perpendicularly from the parallel portions in intersecting relation thereto, and are disposed in contiguous relation to the upstanding wall; and wherein the holding portion holds the wires to install the wires on an inner surface of the cover portion so that the wires are bent into a generally L-shape.

14. The connector according to claim 13, wherein the parallel portions and the intersecting portions are generally in the form of groove concaves on the inner surface of the cover portion.

* * * * *